US005927958A

United States Patent [19]

Sakata et al.

[11] Patent Number: 5,927,958

[45] Date of Patent: Jul. 27, 1999

[54] FLUID MACHINERY HAVING A SEALING MEMBER BETWEEN STEPPED SPIRALS

[75] Inventors: Hirotsugu Sakata; Masayuki Okuda; Satoshi Oyama, all of Tokyo, Japan

[73] Assignee: Kabushiki Kaisha Toshiba, Kawasaki, Japan

[21] Appl. No.: 08/818,670

[22] Filed: Mar. 14, 1997

[30] Foreign Application Priority Data

Mar. 14, 1996 [JP] Japan ..... 8-057758

[51] Int. Cl.[6] ..... F01C 1/04; F01C 19/06

[52] U.S. Cl. ..... 418/55.2; 418/55.4

[58] Field of Search ..... 418/55.2, 55.4, 418/140

[56] References Cited

U.S. PATENT DOCUMENTS

| | | | |
|---|---|---|---|
| 801,182 | 6/1905 | Creux | 418/55.2 |
| 4,199,308 | 4/1980 | McCullough | 418/55.4 |
| 5,603,614 | 2/1997 | Sakata et al. | 418/55.2 |

*Primary Examiner*—John J. Vrablik
*Attorney, Agent, or Firm*—Foley & Lardner

[57] ABSTRACT

A fluid machinery is disclosed which is able to assure a large compression volume without an increase in size and achieve high compressibility by suppressing leakage from sealing, thereby improving the reliability. In the fluid machinery, a second spiral 13 having a spiral inner engaging surface 17 formed to have a stepped shape in section is engaged with a first spiral 15 having an outer engaging surface 21 with a stepped sectional shape which rises upwardly from an outer peripheral side to a central side in a spiral manner, so that sealed spaces 25 are formed to cause reduction in volume of sealed spaces in both radial and height directions from a peripheral side to a central side. A closed spaces 35 having an inclination surface 19 is formed between a stepped surface of the outer engaging surface 21 of the first spiral 15 and a stepped surface of the inner engaging surface 17 of the second spiral 13. A spiral member 37 having a slant surface 39 which engages always with the inclination surfaces 19 is provided in the sealed spaces 35 so as to seal the lower pressure sealed spaces 25 and the higher pressure sealed spaces 25.

15 Claims, 9 Drawing Sheets

0°

90°

270°

180°

FLUID MACHINERY HAVING A SEALING MEMBER BETWEEN STEPPED SPIRALS

BACKGROUND OF THE INVENTION

1. Field of the Invention

The present invention relates to a fluid machinery which is suited for compressor, pump, or expander.

2. Description of the Prior Art

In the prior art, for example, there has been a scroll compressor as a representative example which is most similar to the present invention in the field of compressor.

In summary, the scroll compressor is formed to have such a structure that, if a rotating scroll is rotated after a spiral body of a stationary scroll is engaged with a spiral body of the rotating scroll, a compression chamber whose volume is reduced sequentially from the outer peripheral side to the central side can be formed, so that working fluid, after compressed, can be discharged from a discharge port provided on the central side.

Since the scroll compressor can compress the working fluid from the outer peripheral side toward the central side in the radial direction, a compression volume is determined according to a radius of the rotating scroll. Therefore, if the compression volume is increased, the radius of the rotating scroll is increased correspondingly, whereby resulting in an increase in size of the overall scroll compressor. In addition, since respective spiral bodies may serve as an inner engaging surface and an outer engaging surface respective outside and inside surfaces of which contact with each other, the inner engaging surface and the outer engaging surface of respective spiral bodies must be worked with good precision respectively. As a result, the conventional spiral bodies are disadvantageous in respect of the workability.

SUMMARY OF THE INVENTION

Therefore, the present invention has been made in the light of the above circumstances, and it is an object of the present invention to provide a fluid machinery which is able to extend a compression volume without an increase in size and also prevent sealing leakage to thus achieve a high efficiency.

It is another object of the present invention to provide a fluid machinery which is able to form a large compression volume without an increase in size in both radial and height directions.

It is still another object of the present invention to provide a fluid machinery which is able to seal firmly a lower pressure side compression chamber and a higher pressure side compression chamber by virtue of a spiral member moved along an inclination surface to thus achieve a high compression efficiency.

It is yet still another object of the present invention to provide a fluid machinery which is able to prevent stress concentration caused in an outer engaging surface and an inner engaging surface by means of R portions provided thereto to thus improve the reliability, and also attain the merit of prolonging the life of an end mill to work the R portion.

It is further object of the present invention to provide a fluid machinery which is able to facilitate working of a rotating spiral by selecting a right angle as an angle between an outer engaging horizontal surface and an outer engaging surface both constituting a closed space.

It is still further object of the present invention to provide a fluid machinery which is able to prevent flashes of a spiral member to thus accomplish a stable sealing condition.

In order to achieve the above objects of the present invention, according to an aspect of the present invention, there is provided a fluid machinery comprising a sealing case; a first spiral incorporated into said sealing case and having an outer engaging surface with a stepped sectional shape which rises upwardly from an outer peripheral side to a central side in a spiral manner; a second spiral incorporated into said sealing case and having an inner engaging surface to be rotated in a relative spiral manner to said first spiral and with a stepped shape in section; means for supporting said first spiral and said second spiral to engage said outer engaging surface with said inner engaging surface such that a plurality of sealed spaces are formed between said outer engaging surface and said inner engaging surface to cause reduction in volume of sealed spaces from a peripheral side to a central side by virtue of a relative spiral motion between said first spiral and said second spiral; and a sealing member provided along said outer engaging surface and said inner engaging surface in a spiral fashion.

In the preferred embodiment of the present invention, said sealing member has a triangular sectional shape.

In the preferred embodiment of the present invention, a height of said sealing member in an axial direction is increased from a low pressure side to a high pressure side of said sealed spaces.

In the preferred embodiment of the present invention, a lateral surface and a vertical surface of said sealing member are formed to have a right angle.

In the preferred embodiment of the present invention, at least one of three corners constituted of a lateral surface, a vertical surface, and a slant surface of said sealing member in section is chamfered.

In the preferred embodiment of the present invention, at least one of three corners constituted of a lateral surface, a vertical surface, and a slant surface of said sealing member in section is rounded as an R portion.

In the preferred embodiment of the present invention, said outer engaging surface and said sealing member are engaged with each other at plural surfaces.

In the preferred embodiment of the present invention, an outer spiral horizontal surface and an inner spiral slant surface which is inclined against said outer spiral horizontal surface are provided on said outer engaging surface and said inner engaging surface respectively, and said outer spiral horizontal surface and said inner spiral slant surface are always engaged with each other via said sealing member.

In the preferred embodiment of the present invention, said outer engaging surface and said inner engaging surface have respective engaging horizontal surfaces which engage directly with each other without said sealing member.

In the preferred embodiment of the present invention, said inner engaging surface of said second spiral has an inner spiral vertical surface continued to said inner spiral slant surface via an R portion.

In the preferred embodiment of the present invention, a width of said engaging horizontal surface, a gradient of said inner spiral slant surface, and a radius of said R portion are varied in accordance with a spiral position of stepped surfaces.

In the preferred embodiment of the present invention, a sectional shape of said sealing member is identical to a sectional shape of a sealed space which is constituted of said inner spiral slant surface provided on a second spiral surface, and said outer spiral horizontal surface and an outer spiral vertical surface both constituting said first spiral.

In the preferred embodiment of the present invention, a corner formed to be continued from said outer spiral horizontal surface to said outer spiral vertical surface of said first spiral is formed as an R portion which has a radius substantially equal to or slightly larger than an R portion provided on a second spiral side.

In the preferred embodiment of the present invention, a corner which rises upwardly from said outer engaging horizontal surface of said first spiral to continue to said outer engaging surface is formed as an R portion.

In the preferred embodiment of the present invention, a height of said outer spiral horizontal surface of said first spiral is lowered toward an outer side.

In the preferred embodiment of the present invention, an inclination of said outer spiral horizontal surface of said first spiral in height dimension is lowered toward an outer side.

According to such fluid machinery, a working gas which is supplied from the outer peripheral side of the fluid machinery may be fed upwardly to the central side of the fluid machinery, while being compressed, by virtue of the spiral motion of the first spiral with respect to the second spiral via the sealed space whose volume is reduced gradually from the outer peripheral side to the central side, and then be discharged from the central side of the fluid machinery. In the middle of the spiral motion of the first spiral, the compression volume may be determined by a radial dimension and a height dimension of the sealed space, and also the lateral surface of the spiral member which is slid along the inclination surface of the second spiral may contact to the outer engaging horizontal surface without local pressure, whereby enabling tight sealing between the lower pressure sealed space and the higher pressure sealed space. Further, the spiral member may be fitted into the closed space, if formed as a triangle in section, such that respective surfaces of the spiral member contact to the inclination surface, the outer engaging horizontal surface, and the outer engaging surface of the closed space respectively, whereby enabling firm sealing condition and high compression pressure.

DETAILED DESCRIPTION OF THE PREFERRED EMBODIMENTS

First, a fluid machinery according to a first embodiment of the present invention will be explained in detail with reference to FIGS. 1 to 8 hereinbelow.

Although the fluid machinery of the present invention may be used as compressor, expander, or pump in view of its configuration, it will be explained hereinafter by taking the compressor as an illustrative example on the convenience of explanation for its configuration and its operation. However, in the following description, the present invention is not limited to only the compressor.

Figure 1:
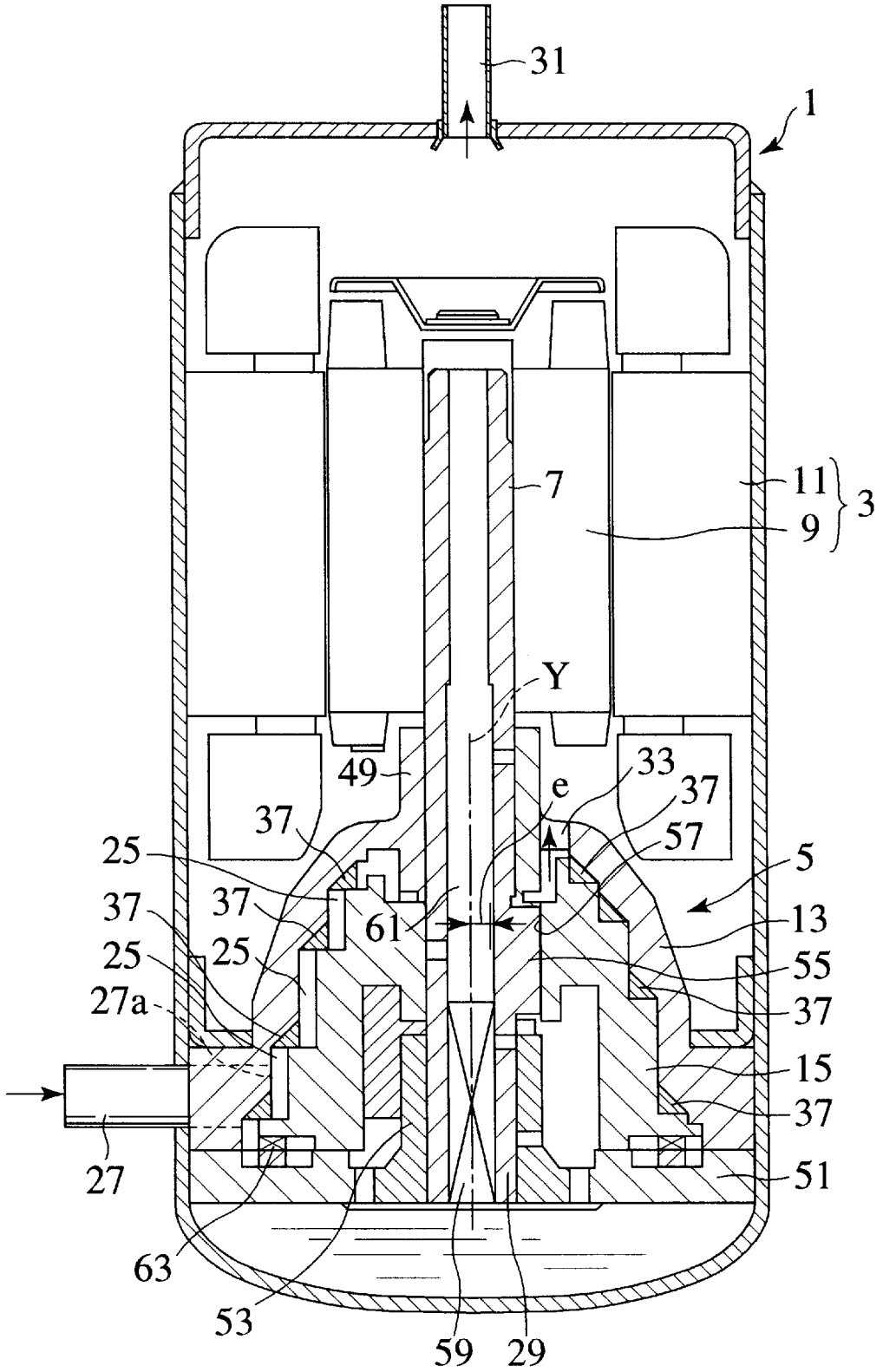
FIG. 1 is a schematic sectional view, partially cut away, showing a configuration of a fluid machinery according to a first embodiment of the present invention.

FIG. 1 shows the fluid machinery according to the first embodiment of the present invention. In FIG. 1, a reference 1 denotes a sealed case. A driving motor 3 and a compressing mechanism section 5 serving as an operating mechanism section are incorporated into the sealed case 1.

The driving motor 3 comprises a rotor 9 fixed to a main axis 7, and a stator 11 fixed and supported to an inner wall surface of the sealed case 1. A rotating power can be applied to the main axis 7 via the rotor 9 when a current is supplied to the stator 11.

The compressing mechanism section 5 comprises a stationary spiral 13 serving as a second spiral, and a rotating spiral 15 serving as a first spiral. A main axis 29 which is coupled integrally to the main axis 7 is provided to penetrate the compressing mechanism section 5.

Figure 2:
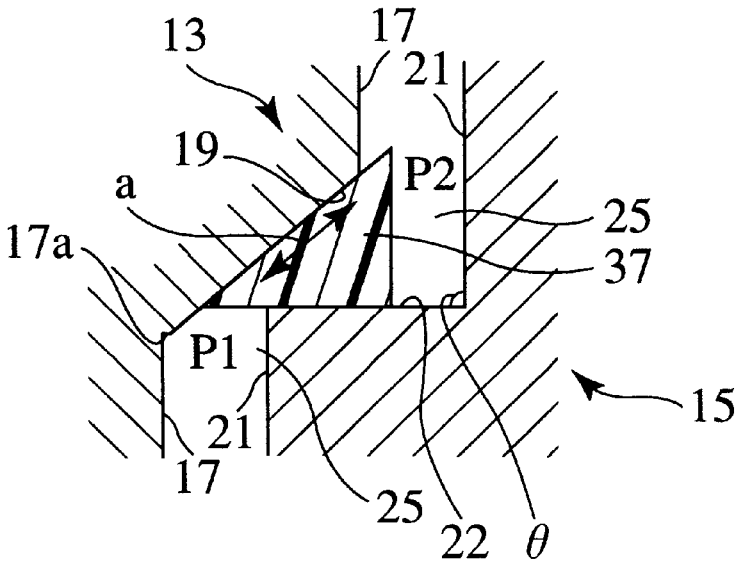
FIG. 2 is a fragmentary enlarged sectional view showing a sealed condition formed between a lower pressure side compression chamber and a higher pressure side compression chamber by virtue of a spiral member fitted into a closed space having an inclination surface.
Figure 8:
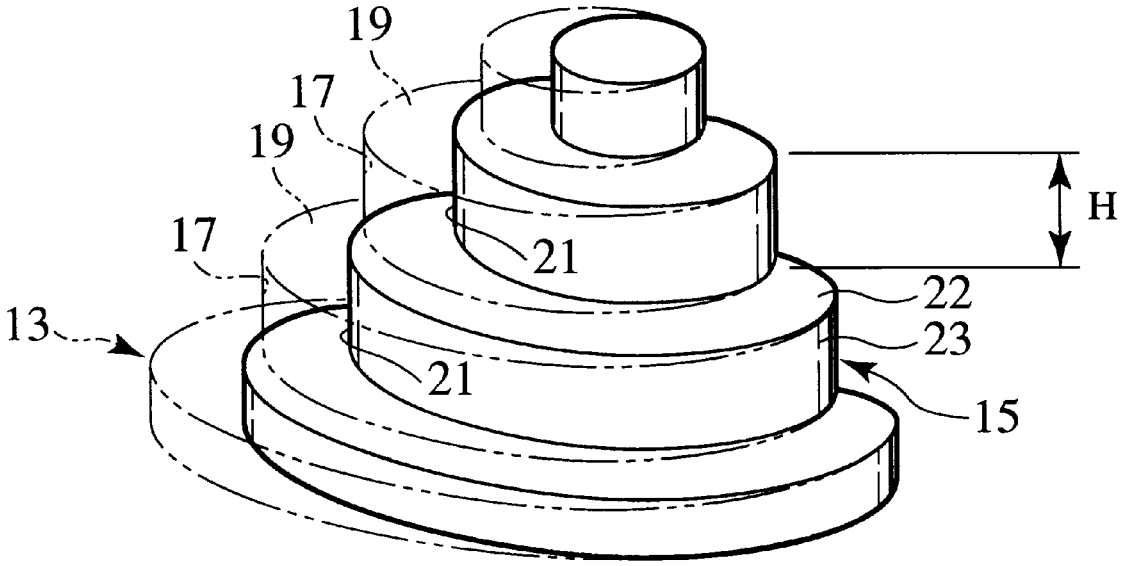
FIG. 8 is a schematic view showing engagement between the stationary spiral and the rotating spiral.

In the stationary spiral 13, as shown in FIG. 8, a radius of an inner engaging surface 17 which rises upwardly from an outer peripheral side to a central side in a spiral manner is reduced gradually toward the inside. Also, as shown in FIG. 2, an inner engaging horizontal surface 17*a*, which has a predetermined short width extended from the inner engaging surface 17, and an inclination surface 19 are formed to constitute an inner spiral stepped shape. The stationary spiral 13 is fixed to an inner wall surface of the sealed case 1.

In the rotating spiral 15, as shown in FIG. 8, an outer engaging surface 21 which rises upwardly from the outer peripheral side to the central side in a spiral fashion is formed, and a radius of the outer engaging surface 21 is reduced gradually toward the central side. The outer engaging surface 21 and the outer engaging horizontal surface 22, which is formed to connect the outer engaging surfaces 21 to each other in section, may constitute an outer spiral stepped shape.

Figure 3:
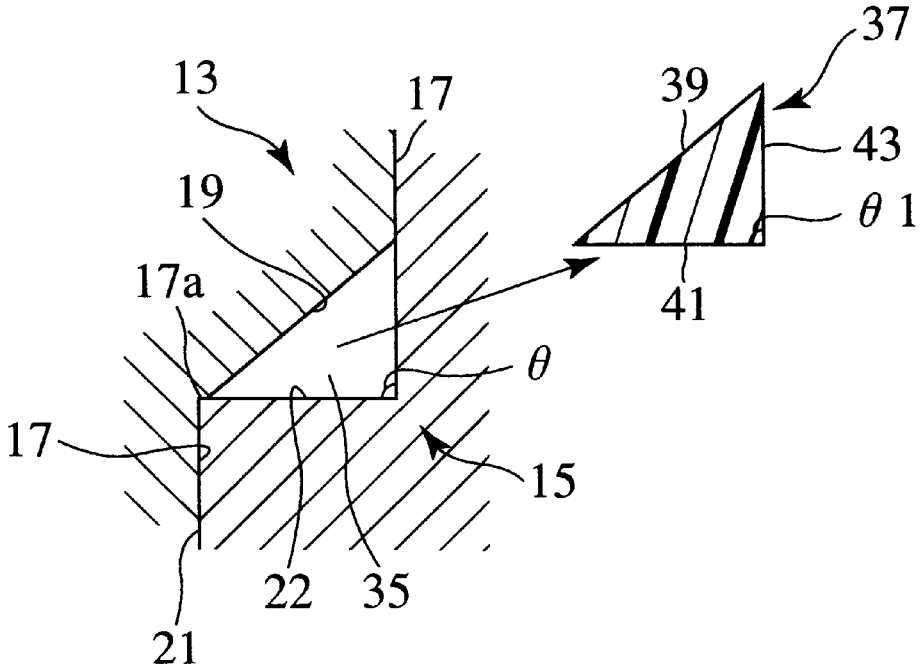
FIG. 3 is a fragmentary enlarged sectional view showing a triangular closed space in section formed by a stationary spiral and a rotating spiral.

As shown in FIGS. 2 and 3, if the outer engaging surface 21 of the rotating spiral 15 is engaged with the inner engaging surface 17 of the stationary spiral 13, a compression chamber 25 acting as a sealed space is then formed.

Compression steps executed by the stationary spiral 13 and the rotating spiral 15 are illustrated from (a) to (d) in FIG. 6.

First, (a) in FIG. 6 shows compression process at a starting point of spiral motion (a rotation angle 0°) of the rotating spiral 15.

Then, (b) in FIG. 6 shows compression process if the rotating spiral 15 is rotated by an angle 90° from the starting point of spiral motion.

Then, (c) in FIG. 6 shows compression process if the rotating spiral 15 is rotated by an angle 180° from the starting point of spiral motion.

Finally, (d) in FIG. 6 shows compression process if the rotating spiral 15 is rotated by an angle 270° from the starting point of spiral motion.

As shown in FIG. 1, the compression chamber 25 is connected respectively to a suction port 27*a* which is directly connected to a suction pipe 27 extended to the outside of the sealed case 1 and to a discharge port 33 which is connected to a discharge pipe 31 provided to an upper portion of the sealed case 1 via an inner space of the sealed case 1. Therefore, if the spiral motion of the rotating spiral 15 is started, a volume of a working gas supplied from the suction port 27*a* can be reduced toward the central side, as shown from (a) to (d) in FIG. 6, and then the working gas is discharged from the discharge port 33.

In this case, it is preferable to provide a check valve (not shown) to the suction port 27*a* or the discharge port 33. The check valve can prevent a back flow of the gas when the rotating spiral 15 is reversely operated before stopping.

A compression volume of the compression chamber 25 can be determined by a radial dimension of spiral and a pitch H of the stepped sectional shape. As shown in FIGS. 2 and 3, sealing of the compression chamber 25 can be assured by a spiral member 37 serving as a sealing member which is fitted into a closed space 35 having an inclination surface 19.

The closed space 35 is formed by combining the inclination surface 19, which is formed between the inner engaging surfaces 17 of the stationary spiral 13, with the outer engaging surface 21 and the outer engaging horizontal surface 22 constituting the rotating spiral 15 in a spiral manner. An angle θ between the outer engaging surface 21 and the outer engaging horizontal surface 22 is selected as a right angle.

The inclination surface 19 is inclined upwardly toward the central side in section in the radial direction. The inner engaging horizontal surface 17a is formed to be continued to the inner engaging surfaces 17 at a substantially right angle.

The spiral member 37 is formed to have a triangular sectional shape consisting of a slant surface 39 which is made to contact always to the inclination surface 19, a lateral surface 41 which is caused to contact always to the outer engaging horizontal side 22, and a vertical surface 43 which is rendered to contact to the outer engaging surface 21.

An angle θ 1 between the lateral surface 42 and the vertical surface 43 is set to a right angle. As shown in FIG. 3, in case the closed space 35 with a triangular sectional shape is constituted during the spiral motion of the rotating spiral 15, the slant surface 39, the lateral surface 41, and the vertical surface 43 of the spiral member 37 are brought surely into tight contact with the inclination side 19, the outer engaging horizontal side 22, and the outer engaging side 21 of the rotating spiral 15 respectively.

Figure 5A:
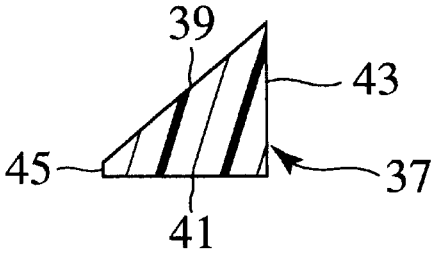
FIG. 5A is a sectional view showing a spiral member having one cut-away corner in section.
Figure 5B:
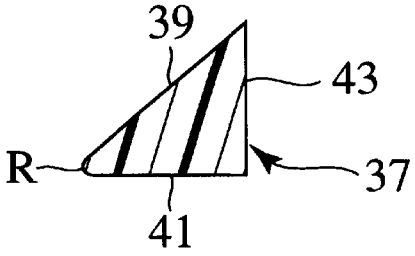
FIG. 5B is a sectional view showing a spiral member having one rounded corner as an R portion in section.
Figure 6A:
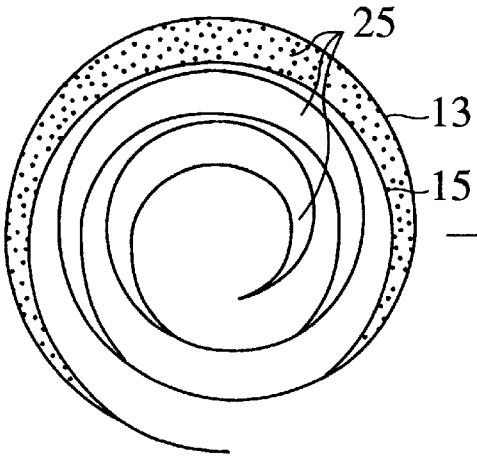
FIGS. 6A–6O are views illustrating operations of the rotating spiral in the course of compression process.
Figure 6B:
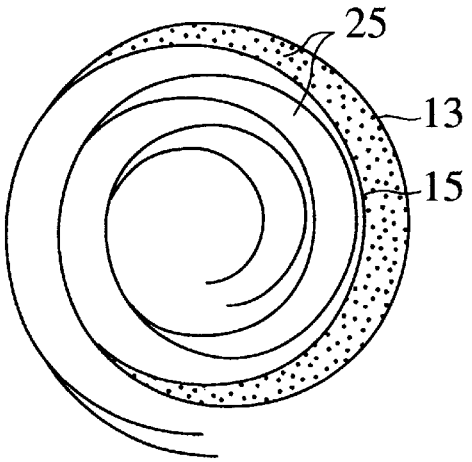
Figure 6D:
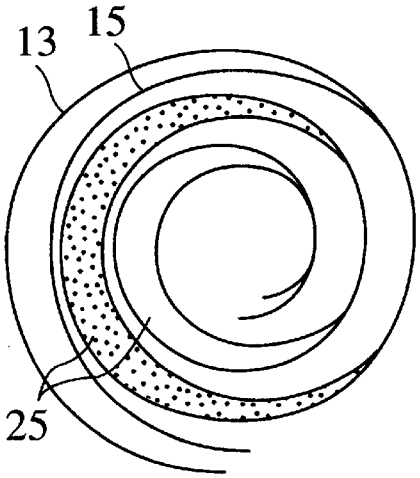
Figure 6C:
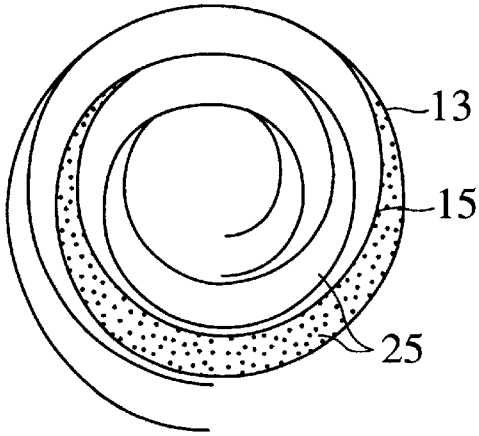

In that case, if the spiral member 37 is formed to have a sectional shape 45 in which, as shown in FIG. 5A, an intersecting corner between the lateral surface 41 and the slant surface 39 is cut away or, as shown in FIG. 5B, the intersecting corner is rounded as an R portion R, for instance, it becomes very desirable in the respect of workability because flashes of the spiral member 37 can be prevented from being produced in working.

In the meanwhile, the main axis 29 passing through the compressing mechanism section 5 is coupled integrally to the main axis 7 of the driving motor 3. The main axis 29 is supported rotatably at both ends by a main bearing 49 of the stationary spiral 13 and an auxiliary bearing 53 of a supporting frame 51 which is fixed to an inner wall surface of the sealed case 1.

An eccentric axis portion 55 which is eccentric from an axis center Y by a predetermined amount e is provided to the main axis 29. A bearing portion 57 of the rotating spiral 15 is inserted rotatably into the eccentric axis portion 55. Lubricating oil is fed to the main bearing 49 and the auxiliary bearing 53 as well as the bearing portion 57 of the rotating spiral 15 via a lubricating oil passage 61 by an oil pump 59 which is provided on an lower end of the main axis 29.

Further, rotation preventing mechanisms 63 such as Oldham's rings are provided on the bottom surface of the rotating spiral 15 and between the supporting frame 51 and the rotating spiral 15.

The rotation preventing mechanisms 63 function to suppress a rotation of the rotating spiral 15 due to rotation of the eccentric axis portion 55, so that a spiral motion can be transferred to the rotating spiral 15.

According to the fluid machinery constituted as above, a working gas supplied from the suction port 27*a* outer may be carried upwardly to the central area of the fluid machinery, while being compressed, by virtue of the spiral motion of the rotating spiral 15 with respect to the stationary spiral 13 via the compression chamber 25 a volume of which is reduced gradually from the outer peripheral side to the central side, then be discharged from the discharge port 33 to the sealed case 1, and then supplied from the discharge pipe 31 to the outside of the fluid machinery. In the course of the spiral motion of the rotating spiral 15, the compression volume may be determined by a radial dimension and a height dimension of the compression chamber 25 and as a result a large compression volume can be achieved without an increase in size of the fluid machinery.

Figure 7:
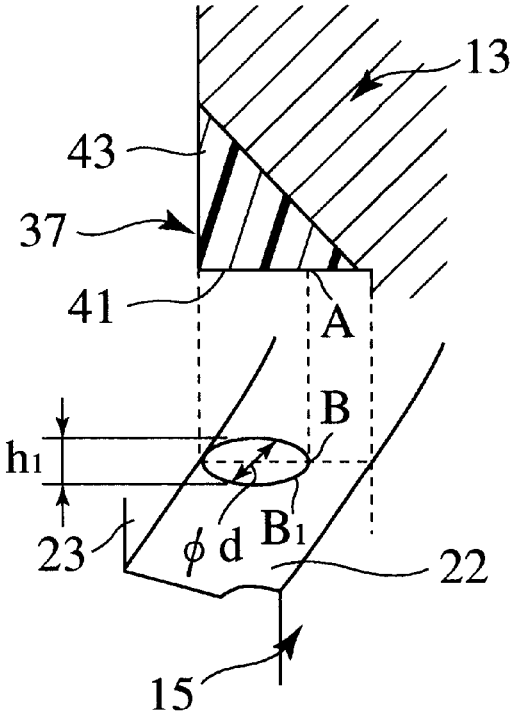
FIG. 7 is a view illustrating a sliding motion of a lateral surface of the spiral member on an outer engaging horizontal surface.

In the meanwhile, the lateral surface 41 of the spiral member 37 may slide on the outer engaging horizontal surface 22. In other words, as shown in FIG. 7, in the spiral motion of the rotating spiral 15, a point A on the lateral surface 41 of the spiral member 37 contacts to a point B on the outer engaging horizontal surface 22 constituting a slope which is inclined upwardly in a spiral manner. If the rotating spiral 15 is rotated, the contact point B is also rotated to be shifted from the contact point A. From an observation of this rotation, it may be understood that another contact point B1 on the outer engaging horizontal surface 22 contacts to the contact point A. Therefore, a series of contact points B1 which contact sequentially to the contact point A constitute a closed curve which can be derived by projecting a circle of a diameter $\phi$ d on the slope of the outer engaging horizontal surface 22. Since the contact point A contacts to the slant closed curve, it moves a height distance along the height direction of the fluid machinery, which is equal to a height difference hi of the closed curve in the axial direction.

Therefore, the spiral member 37 is pushed up if the higher contact point B passes through the contact point A whereas the spiral member 37 is pulled down if the lower contact point B passes through the contact point A. When the spiral member 37 is pushed up, it is also pushed to the lower pressure side compression chamber 25 because of differential pressure between the pressure P2 in the higher pressure side compression chamber 25 and the pressure P1 in the lower pressure side compression chamber 25 (P2>P1). That is, the spiral member 37 is pushed to the outer engaging horizontal surface 22 of the rotating spiral 15.

At this time, the slant surface 39 of the spiral member 37 is also pushed to the inclination surface 19 of the stationary spiral 13 due to the differential pressure. As a result, as shown in FIG. 2, the spiral member 37 may slide on the inclination surface 19 in the direction indicated by an arrow (a) during the rotation motion of the rotating spiral 15.

Accordingly, when the rotating spiral 15 is rotated, the lateral surface 41 of the spiral member 37 is made to tightly contact to the outer engaging horizontal surface 22 of the rotating spiral 15 and at the same time the slant surface 39 of the spiral member 37 is made to contact tightly to the inclination surface 19 of the stationary spiral 13.

Figure 4:
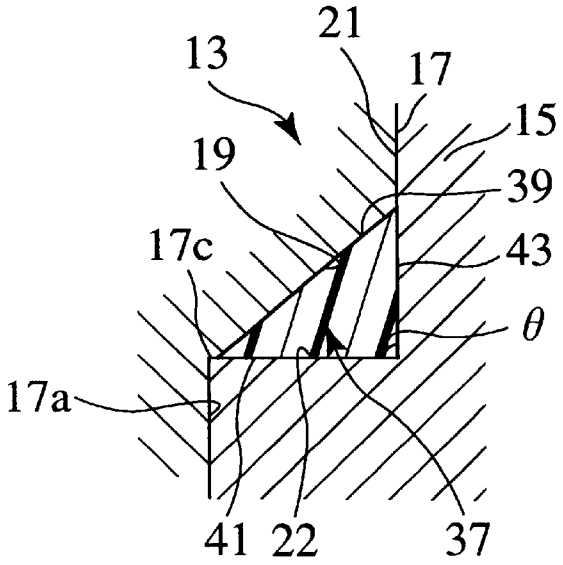
FIG. 4 is a fragmentary enlarged sectional view showing the spiral member which is fitted into the triangular closed space in section formed by an inner engaging surface of the stationary spiral and an outer engaging surface of the rotating spiral such that three sides, i.e., lateral surface, vertical surface, and slant surface of the spiral member are brought into tight contact with respective surfaces of the triangular closed space.

As shown in FIGS. 3 and 4, when the closed space 35 having a triangular sectional shape is constituted, the slant surface 39, the lateral surface 41, the vertical surface 43 of the spiral member 37 is brought into tight contact with the inclination surface 19, the outer engaging horizontal surface 22, and the outer engaging surface 21 of the stationary spiral 13 respectively. As a result, sealing leakage of the compression chamber 25 can be suppressed firmly, whereby enabling a high compression efficiency. In addition, because the outer engaging horizontal surface 22 and the outer engaging surface 21 are formed to have a right angle, working of the outer engaging horizontal surface 22 of the rotating spiral 15 can be facilitated and in addition only the outer engaging surface 21 is to be worked.

Figure 9:
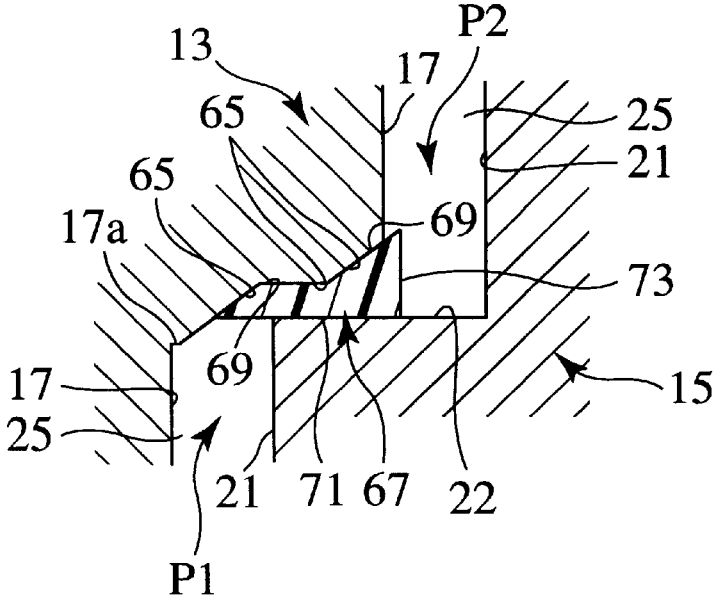
FIG. 9 is a fragmentary enlarged sectional view showing a configuration of a fluid machinery according to a second embodiment of the present invention wherein, like FIG.2, a sealed condition in which slant surfaces of a spiral member are made to contact to a plurality of inclination surfaces of a stationary spiral.

FIG. 9 shows a relation between a spiral member 67 and the closed space 35 having plural inclination surfaces 65 according to a second embodiment of the present invention.

In the second embodiment of the present invention, the spiral member 67 is fitted into the closed space 35 which is composed of plural inclination surfaces 65 provided on the inner engaging surface 17 of the stationary spiral 13, and the outer engaging horizontal surface 22 and the outer engaging vertical surface 21 of the rotating spiral 15.

The spiral member 67 is made up of plural slant surfaces 69 which always contact to the inclination surfaces 65 of the stationary spiral 13, a lateral surface 71 which always contact to the outer engaging horizontal surface 22 of the rotating spiral 15, and a vertical surface 73 which contact to the outer engaging vertical surface 21 of the rotating spiral 15.

Since remaining constituent elements of the second embodiment are the same as the first embodiment in FIG. 2, their detailed description will be omitted by labeling such elements the same references.

According to this embodiment of the present invention, in addition to the foregoing advantages, sealing between the low pressure P1 side compression chamber 25 and the high pressure P2 side compression chamber 25 can be made firmly by virtue of contact between the plural slant surfaces 69 and the inclination surfaces 65 to thereby eliminate sealing leakage. As a result, a higher compression efficiency can be attained by the second embodiment.

Figure 10:
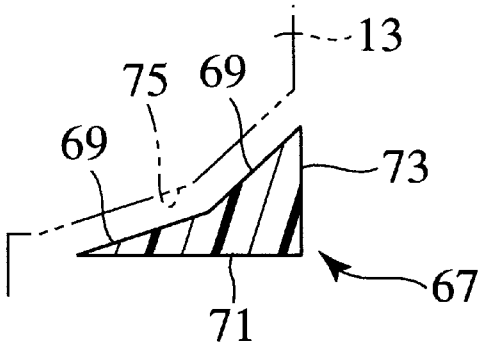
FIG. 10 is a sectional view showing another spiral member having the slant surfaces with different inclination degree.
Figure 11:
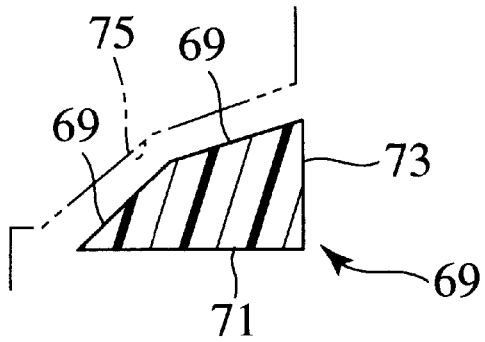
FIG. 11 is a sectional view showing still another spiral member having the slant surfaces with different inclination degree.

In this case, as shown in FIGS. 10 and 11, plural slant surfaces 69 of the spiral member 67 may be formed to have different inclination degrees which correspond to inclinations of plural inclination surfaces 75 provided on the stationary spiral 13.

In a modification shown in FIG. 10, since the spiral member 67 can be easily twisted, sealing performance of the spiral member 67 between the outer engaging horizontal surface 22 and the outer engaging surface 21 of the rotating spiral 15 can be improved. In other words, torsional rigidity of the spiral member 67 can be expressed by $$\text{torsional rigidity} = (\text{modulus of transverse elasticity}) \times (\text{polar moment of inertia of area})$$

Where modulus of transverse elasticity is associated with material of the spiral member 67, and polar moment of inertia of area is associated with a sectional shape of the spiral member 67.

For this reason, since polar moment of inertia of area can be made small according to the spiral member 67 in FIG. 10, the torsional rigidity can be reduced and therefore twist of the spiral member 67 can be made easy. Therefore, hard material, i.e., material having high modulus of transverse elasticity can be selected within torsion tolerance. If such hard material is employed, a stable sealing condition can be maintained for a long time.

In another modification shown in FIG. 11, the spiral member 67 is hard to be twisted in contrast with the modification in FIG. 10. However, since a sectional area of the spiral member 67 can be increased, working of the spiral member 67 can be made easy to thus improve workability. Therefore, the spiral member 67 can be achieved with good precision so that improvement in performance of the fluid machinery can be accelerated.

Figure 12:
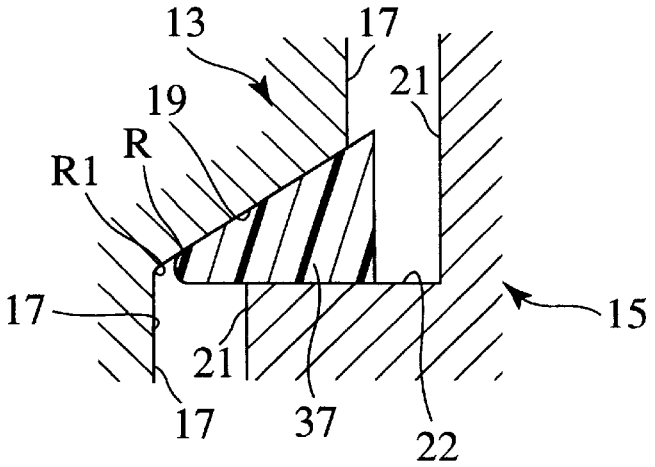
FIG. 12 is a fragmentary enlarged sectional view showing a configuration of a fluid machinery according to a third embodiment of the present invention wherein, like FIG. 2, a stationary spiral in which a corner continued to an inclination surface of the stationary spiral is rounded as an R portion.

FIG. 12 shows a closed space 35 having an inclination surface 19 according to a third embodiment of the present invention.

In the third embodiment of the present invention, a corner portion which being continued from the inner engaging surface 17 to the inclination surface 19 is formed as an R1 portion.

Since remaining constituent elements of the third embodiment are the same as the first embodiment in FIG. 2, their detailed description will be omitted by labeling such elements the same references.

Therefore, in the third embodiment of the present invention, since an end mill such as working machine having a rounded corner may be used to form an R portion R1, such a merit in working the stationary spiral 13 can be achieved that the life of the end mill can be extended several times.

As shown in FIG. 12, in the third embodiment of the present invention, it is desirable to use the spiral member 37 having an R portion R which fits to the R portion R1 of the stationary spiral 13.

In this event, an inclination of the outer engaging horizontal surface 22 of the rotating spiral 15 which rises up toward the central side in a spiral fashion is made different along the spiral outer engaging horizontal surface 22 and further a moving amount of the spiral member 37 is made different along the inclination surface 19 of the stationary spiral 13. Therefore, it may be desired that an inclination degree of the inclination surface 19, a radius of the R portion R1 formed on the corner portion continued from the inner engaging surface 17 to the inclination surface 19, or a width of the inner engaging horizontal surface 17*a* on the corner portion is continuously changed in the stationary spiral 13 side so as to correspond to the slope of the outer engaging horizontal surface 22 of the rotating spiral 15. Consequently, a moving amount of the spiral member 37 along the inclination surface 19 can be made constant to thus stabilize sealing performance of the spiral member 37.

Figure 13:
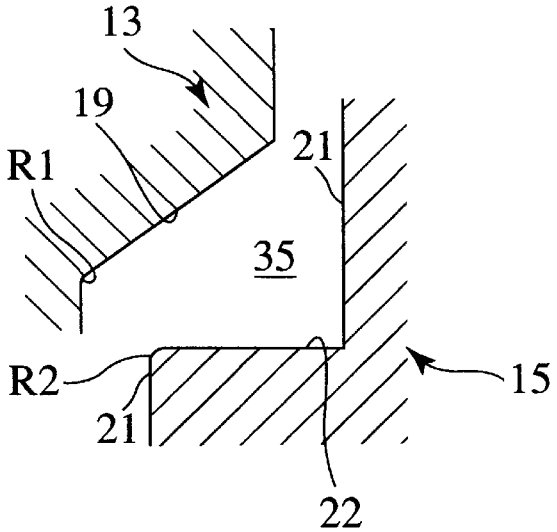
FIG. 13 is a fragmentary enlarged sectional view showing a configuration of a fluid machinery according to a fourth embodiment of the present invention wherein a rotating spiral in which a corner of an outer engaging surface is rounded as an R portion which corresponds to and contacts tightly to the R portion formed on the corner continued to the inclination surface of the stationary spiral.
Figure 14:
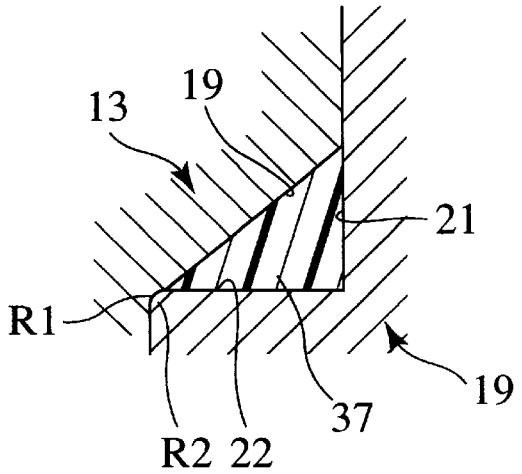
FIG. 14 is a fragmentary enlarged sectional view showing the spiral member which is fitted into the closed space formed to have a triangular sectional shape in FIG. 13 such that three sides, i.e., lateral surface, vertical surface, and slant surface of the spiral member in section are brought into tight contact with the triangular closed space.

FIGS. 13 and 14 show a closed space 35 having the inclination surface 19 according to a fourth embodiment of the present invention.

In the fourth embodiment of the present invention, a corner continued to the inclination surface 19 of the stationary spiral 13 is rounded as an R portion R1, as in FIG. 12, whereas a corner of an outer engaging surface 21 is rounded as the R portion R2 which corresponds to and contacts tightly to the R portion Ri of the inclination surface 19 of the stationary spiral 13.

Since remaining constituent elements of the fourth embodiment are the same as the above embodiments, their detailed description will be omitted by labeling such elements the same references.

According to the fourth embodiment of the present invention, as shown in FIG. 14, when the closed space 35 having a triangular sectional shape is formed during the spiral motion of the rotating spiral 15, metallic contact between the stationary spiral 13 and the spiral member 37 at an acute angle can be avoided and therefore a stable engagement state can be obtained between the stationary spiral 13 and the spiral member 37. Still further, because stress concentration caused in the stationary spiral 13 and the rotating spiral 15 can be prevented by virtue of the R portions R1, R2, whereby improving the reliability of the fluid machinery.

Figure 15:
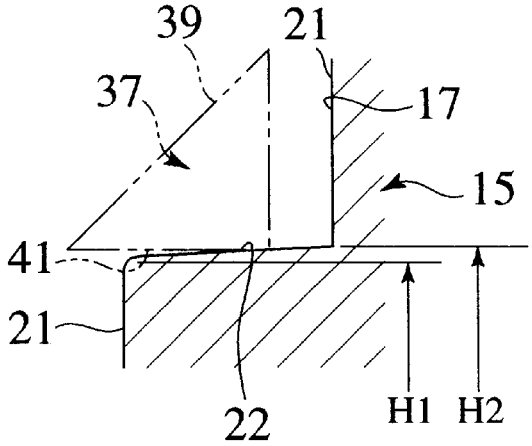
FIG. 15 is a fragmentary sectional view showing a rotating spiral whose overall outer engaging horizontal surface is inclined downwardly from an inner side to an outer side.
Figure 16:
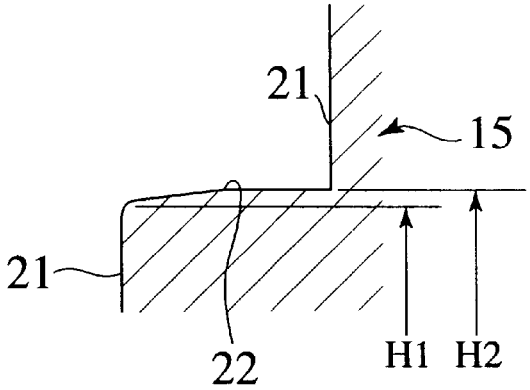
FIG. 16 is a fragmentary sectional view showing a rotating spiral whose outer engaging horizontal surface is inclined downwardly from the middle to the outer side.

In this event, in order to make working of the rotating spiral 15 easy, a height of the outer engaging horizontal surface 22 in section may be decided along the radial direction such that the height is lowered linearly, as shown in FIG. 15, from the inside H2 toward the outside H1, i.e., H1<H2, otherwise, as shown in FIG. 16, from the middle of the outer engaging horizontal surface 22 toward the outside H1. Therefore, local pressure imposed on the lateral surface 41 of the spiral member 37, if slid, can be prevented. In particular, in the rotating spiral 15 in FIG. 16, it may be desirable that the outer engaging horizontal surface 22 is formed as a curved line in section. This is because a corner in section is formed by two intersecting straight lines on the outer engaging horizontal surface 22. Of course, in the rotating spiral 15 in FIG. 15, the curved line in section may be used in place of the straight line.

Figure 17:
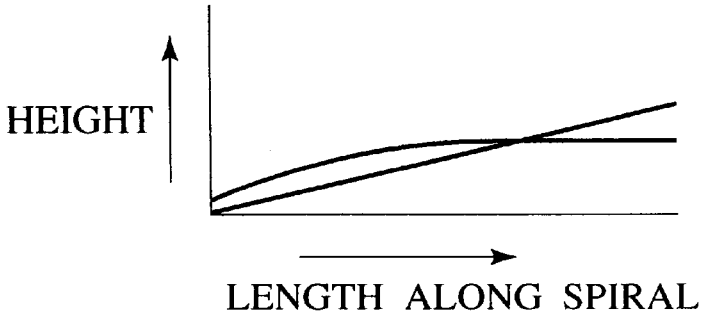
FIG. 17 is a view showing an outer engaging horizontal surface of the rotating spiral if developed.

As shown in FIG. 17, the outer engaging horizontal surface 22 of the rotating spiral 15 which rises upwardly toward the central side in a spiral fashion, if developed along the spiral, can be formed to have a linear length and height relation, a sequential decreasing length and height relation, or a combination of both relations. In this event, when the rotating spiral 15 is rotated, the spiral member 37 is moved upwardly along the inclination surface 19 of the stationary spiral and simultaneously it is moved downwardly along the inclination surface 19 of the stationary spiral on the 180° opposite side. At this time, since the spiral member 37 is moved by the same amount on the right and left sides of the rotating spiral 15, otherwise since the spiral member 37 is moved to have the smaller amount sequentially from the larger diameter side toward the smaller diameter side of the rotating spiral 15, the slant surface 39 of the spiral member 37 is pushed to the inclination surface 19 and therefore a sealing performance of the spiral member 37 can be improved.

Figure 18:
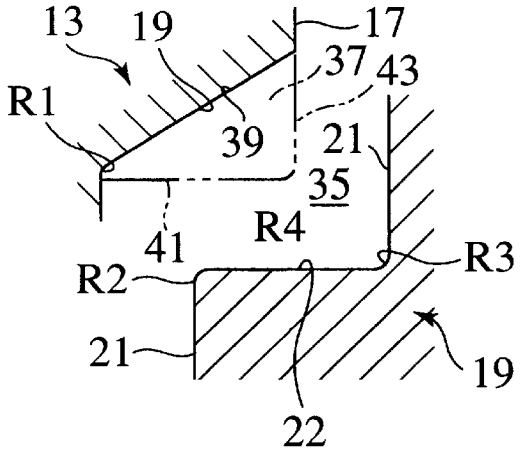
FIG. 18 is a fragmentary sectional view showing a configuration of a fluid machinery according to a fifth embodiment of the present invention wherein, like FIG. 13, a rotating spiral whose corner of an outer engaging horizontal surface rises up from an outer engaging horizontal surface is rounded as an R portion.

FIG. 18 shows a closed space 35 having the inclination surface 19 according to a fifth embodiment of the present invention.

In the fifth embodiment of the present invention, a corner continued to the inclination surface 19 of the stationary spiral 13 is rounded as an R portion R1, as the case in FIG. 13. A corner of the outer engaging surface 21 of the rotating spiral 15 which correspond to and contacts tightly to the R portion R1 is formed as a chamfered R portion R2. Furthermore, a corner formed between the outer engaging horizontal surface 22 and the outer engaging surface 21 is rounded as an R portion R3. On the contrary, an R portion R3 of the spiral member 37, which contacts tightly to the R portion R3 of the rotating spiral 15, is provided by chamfering a corner between the lateral surface 41 and the vertical surface 43.

Figure 19:
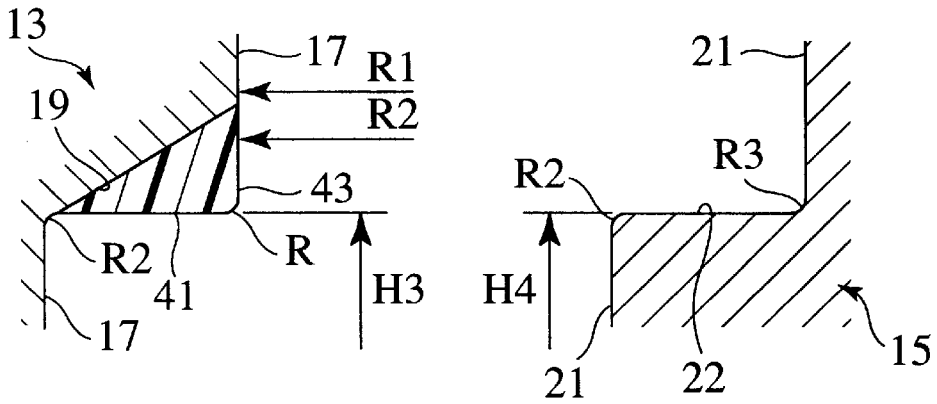
FIG. 19 is a fragmentary sectional view showing requirements between the inner engaging surface and the outer engaging surface so as to fit a spiral member into a closed space having a triangular sectional shape such that three sides, i.e., lateral surface, vertical surface, and slant surface of the spiral member in section are brought into tight contact with respective surfaces of the triangular closed space in section.
Figure 20:
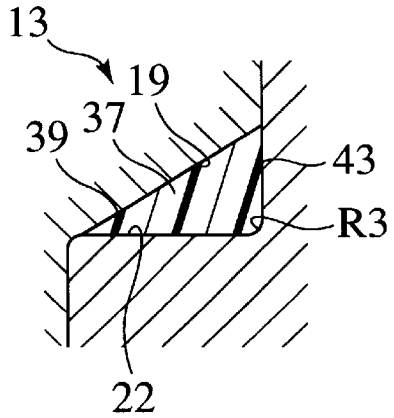
FIG. 20 is a fragmentary enlarged sectional view showing the spiral member which is fitted into the triangular closed space in section in FIG. 18 such that three sides, i.e., lateral surface, vertical surface, and slant surface of the spiral member in section are brought into tight contact with respective surfaces of the triangular closed space.

In this event, as shown in FIG. 19, in case a radius Ri of the inner engaging surface 17 of the stationary spiral 13 and an radius R2 of the vertical surface 43 of the spiral member 37 are set to be the same radii (R1=R2), i.e., to coincide with each other, it may be desirable that a height H3 of the lateral surface 43 of the spiral member 37 is set to be identical to a height H4 of the outer engaging horizontal surface 22 or higher than (H3≧H4) if the rotating spiral 15 is cut out along a section face in which the rotating spiral 15 comes closet to the coincidence point and which includes the outer engaging surface 21 of the rotating spiral 15. Thereby, as shown in FIG. 20, the spiral member 37 can be fitted into the closed space 35 formed upon rotation of the rotating spiral 15 without influence of thermal expansion such that the slant surface 39, the lateral surface 41, and the vertical surface 43 of the spiral member 37 are brought into tight contact with the slant surface 19, the outer engaging horizontal surface 22, the outer engaging surface 21 of the closed space 35 respectively. As a result, high sealing performance and high compression can be achieved by the fluid machinery of the present invention.

What is claimed is:

1. A fluid machinery comprising:

a sealing case;

a first spiral incorporated into said sealing case and having an outer engaging surface having a stepped sectional shape that rises upwardly from an outer peripheral side to a central side in a spiral manner;

a second spiral incorporated into said sealing case and having an inner engaging surface having a stepped sectional shape, said first spiral being rotatable relative to said second spiral;

means for supporting said first spiral and said second spiral to engage said outer engaging surface with said inner engaging surface such that a plurality of sealed spaces are formed therebetween to cause reduction in volume of said sealed spaces from a peripheral side to a central side by virtue of a relative spiral motion between said first spiral and said second spiral; and a sealing member having a triangular sectional shape provided between said outer engaging surface and said inner engaging surface in a spiral fashion.

2. A fluid machinery as claimed in claim 1, wherein a height of said sealing member increases in an axial direction from a low pressure side to a higher pressure side of said sealed spaces.

3. A fluid machinery as claimed in claim 1, wherein said sealing member has a lateral surface and a vertical surface that are perpendicular to each other.

4. A fluid machinery as claimed in claim 3, wherein said sealing member further has a slant surface contiguous with said lateral and vertical surfaces, said lateral surface, said vertical surface, and said slant surface defining three corners at intersections thereof, wherein at least one of said three corners is chamfered.

5. A fluid machinery as claimed in claim 3, wherein said sealing member further has a slant surface contiguous with said lateral and vertical surfaces, said lateral surface, said vertical surface, and said slant surface defining three corners at intersections thereof, wherein at least one of said three corners is rounded.

6. A fluid machinery as claimed in claim 3, wherein said outer engaging surface and said inner engaging surface each have a spiral horizontal surface that engages directly with each other.

7. A fluid machinery as claimed in claim 3, wherein said outer engaging surface has a spiral horizontal surface and a spiral vertical surface, said lateral surface of said sealing member engaging said spiral horizontal surface, and said vertical surface of said sealing member engaging said spiral vertical surface.

8. A fluid machinery as claimed in claim 7, wherein said inner engaging surface has a spiral slant surface that is slanted relative to said spiral horizontal surface, said sealing member engaging said spiral horizontal surface and said spiral slant surface.

9. A fluid machinery as claimed in claim 8, wherein said inner engaging surface has a spiral vertical surface contiguous with said spiral slant surface via a rounded corner.

10. A fluid machinery as claimed in claim 9, wherein a width of said spiral horizontal surface, an inclination of said spiral slant surface, and a radius of said rounded corner vary in accordance with a spiral position of said stepped surfaces.

11. A fluid machinery as claimed in claim 9, wherein said spiral slant surface, said spiral horizontal surface, and said spiral vertical surface form a substantially triangular sectional shape matching said triangular sectional shape of said sealing member.

12. A fluid machinery as claimed in claim 11, wherein said spiral horizontal surface and said spiral vertical surface intersect at a radial outermost portion of said spiral horizontal surface to form a rounded corner having a radius substantially equal to or slightly larger than a radius of said rounded corner of said inner engaging surface.

13. A fluid machinery as claimed in claim 11, wherein said spiral horizontal surface and said spiral vertical surface intersect to form a rounded corner at a radial innermost portion of said spiral horizontal surface.

14. A fluid machinery as claimed in claim 11, wherein a height of said spiral horizontal surface decreases as said spiral horizontal surface extends radially outwardly.

15. A fluid machinery as claimed in claim 11, wherein said spiral horizontal surface is inclined so that a height of said spiral horizontal surface decreases as said spiral horizontal surface extends radially outwardly.

* * * * *